US010833455B2

(12) United States Patent
Chang et al.

(10) Patent No.: US 10,833,455 B2
(45) Date of Patent: Nov. 10, 2020

(54) CONTACT MODULE HAVING DOUBLE-SIDED ARRANGED CONTACTS WITH INSULATOR AND RESPECTIVE EQUAL LENGTH DIFFERENTIAL PAIR THEREOF

(71) Applicants: FU DING PRECISION INDUSTRIAL (ZHENGZHOU) CO., LTD., Zhengzhou (CN); FOXCONN INTERCONNECT TECHNOLOGY LIMITED, Grand Cayman (KY)

(72) Inventors: Yen-Chih Chang, New Taipei (TW); Shih-Wei Hsiao, New Taipei (TW); Na Yang, Kunshan (CN); Xiao-Li Liu, Kunshan (CN); Meng Liu, Kunshan (CN); Yu-Ke Chen, Kunshan (CN)

(73) Assignees: FU DING PRECISION INDUSTRIAL (ZHENGHOU) CO., LTD., Zhenghou (CN); FOXONN INTERCONNECTY TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/729,463

(22) Filed: Dec. 29, 2019

(65) Prior Publication Data

US 2020/0212636 A1 Jul. 2, 2020

(30) Foreign Application Priority Data

Dec. 28, 2018 (CN) ..... 2018 1 1617385

(51) Int. Cl.
*H01R 13/6587* (2011.01)
*H01R 12/72* (2011.01)
(Continued)

(52) U.S. Cl.
CPC ..... *H01R 13/6587* (2013.01); *H01R 12/724* (2013.01); *H01R 13/405* (2013.01); *H01R 13/6471* (2013.01)

(58) Field of Classification Search
CPC . H01R 23/688; H01R 13/658; H01R 33/7628
(Continued)

(56) References Cited

U.S. PATENT DOCUMENTS 5,842,887 A * 12/1998 Andrews ..... H01R 12/724 439/607.1
6,083,047 A * 7/2000 Paagman ..... H01R 13/6587 439/607.07

(Continued)

*Primary Examiner* — Phuong Chi Thi Nguyen
(74) *Attorney, Agent, or Firm* — Wei Te Chung; Ming Chieh Chang

(57) ABSTRACT

An electrical connector includes a pair of opposite contact modules commonly sandwiching a grounding module therebetween in a transverse direction wherein each contact module includes two sided contacts on two sides of an insulator while the front mating sections and/or the bottom connecting sections of all the contacts are aligned in the same line. The contacts on each side of the insulator include a plurality of differential pair contacts and a plurality of grounding contacts alternately arranged with each other along the side face wherein the lengths of the pair of contacts in each differential pair essentially have the same length for reducing skewing effect by extending the body of the lower contact curvedly while keeping that of the upper contact essentially straight in each differential pair.

20 Claims, 15 Drawing Sheets

(51) Int. Cl.
*H01R 13/405* (2006.01)
*H01R 13/6471* (2011.01)

(58) Field of Classification Search
USPC ..... 439/108, 608, 609
See application file for complete search history.

(56) References Cited

U.S. PATENT DOCUMENTS

| | | | | |
|---|---|---|---|---|
| 6,267,604 | B1 * | 7/2001 | Mickievicz | H01R 23/6873 439/79 |
| 6,503,103 | B1 | 1/2003 | Cohen et al. | |
| 6,638,110 | B1 * | 10/2003 | Billman | H01R 13/6471 439/607.07 |
| 6,932,649 | B1 * | 8/2005 | Rothermel | H01R 13/6658 439/620.01 |
| 9,537,239 | B1 | 1/2017 | Liu et al. | |
| 2002/0098738 | A1 * | 7/2002 | Astbury, Jr. | H01R 13/6587 439/607.07 |
| 2002/0111068 | A1 * | 8/2002 | Cohen | H01R 13/6586 439/607.11 |
| 2003/0143894 | A1 * | 7/2003 | Kline | H01R 13/6471 439/607.56 |
| 2003/0220020 | A1 * | 11/2003 | Billman | H01R 13/6471 439/607.07 |
| 2005/0215121 | A1 * | 9/2005 | Tokunaga | H01R 31/06 439/607.13 |

* cited by examiner

CONTACT MODULE HAVING DOUBLE-SIDED ARRANGED CONTACTS WITH INSULATOR AND RESPECTIVE EQUAL LENGTH DIFFERENTIAL PAIR THEREOF

BACKGROUND OF THE DISCLOSURE

1. Field of the Disclosure

The present invention relates to an electrical connector, and particular to the electrical connector including a pair of contact modules each equipped with double-sided arranged contacts on the insulator and respective equal length differential pairs for high speed signal transmission.

2. Description of Related Arts

U.S. Pat. No. 9,537,239 discloses an orthogonal backplane connector wherein the adjacent contacts including the differential pairs extending in a parallel relation. Anyhow, because the transmission lengths of the same differential pair contacts are different from each other, there is a skew due to different electrical delay therebetween, thus degrading the transmission quality thereof.

An improved backplane connector is expected.

SUMMARY OF THE DISCLOSURE

Accordingly, an object of the present disclosure is to provide an electrical connector with a pair of opposite contact modules commonly sandwiching a grounding module therebetween in a transverse direction wherein each contact module includes two sided contacts on two sides of an insulator while the front mating sections and/or the bottom connecting sections of all the contacts are aligned in the same line. The contacts on each side of the insulator include a plurality of differential pair contacts and a plurality of grounding contacts alternately arranged with each other along the side face wherein the lengths of the pair of contacts in each differential pair essentially have the same length for reducing skewing effect by extending the body of the lower contact curvedly while keeping that of the upper contact essentially straight in each differential pair. The contacts on each side of the insulator further include a plurality of grounding contacts arranged densely together either unified as one piece or in a discrete manner.

Another approach of the invention for equalizing the lengths of the corresponding differential pair contacts is to have the body portion of the lower contact and that of the upper contact parallel to each other in a same horizontal plane symmetrically in each differential pair contacts.

The contacts of the pair of contact modules commonly sandwich a printed circuit board type part of the complementary part.

Other objects, advantages and novel features of the disclosure will become more apparent from the following detailed description when taken in conjunction with the accompanying drawings.

DETAILED DESCRIPTION OF THE PREFERRED EMBODIMENT

Reference will now be made in detail to the embodiments of the present disclosure.

Figure 1:
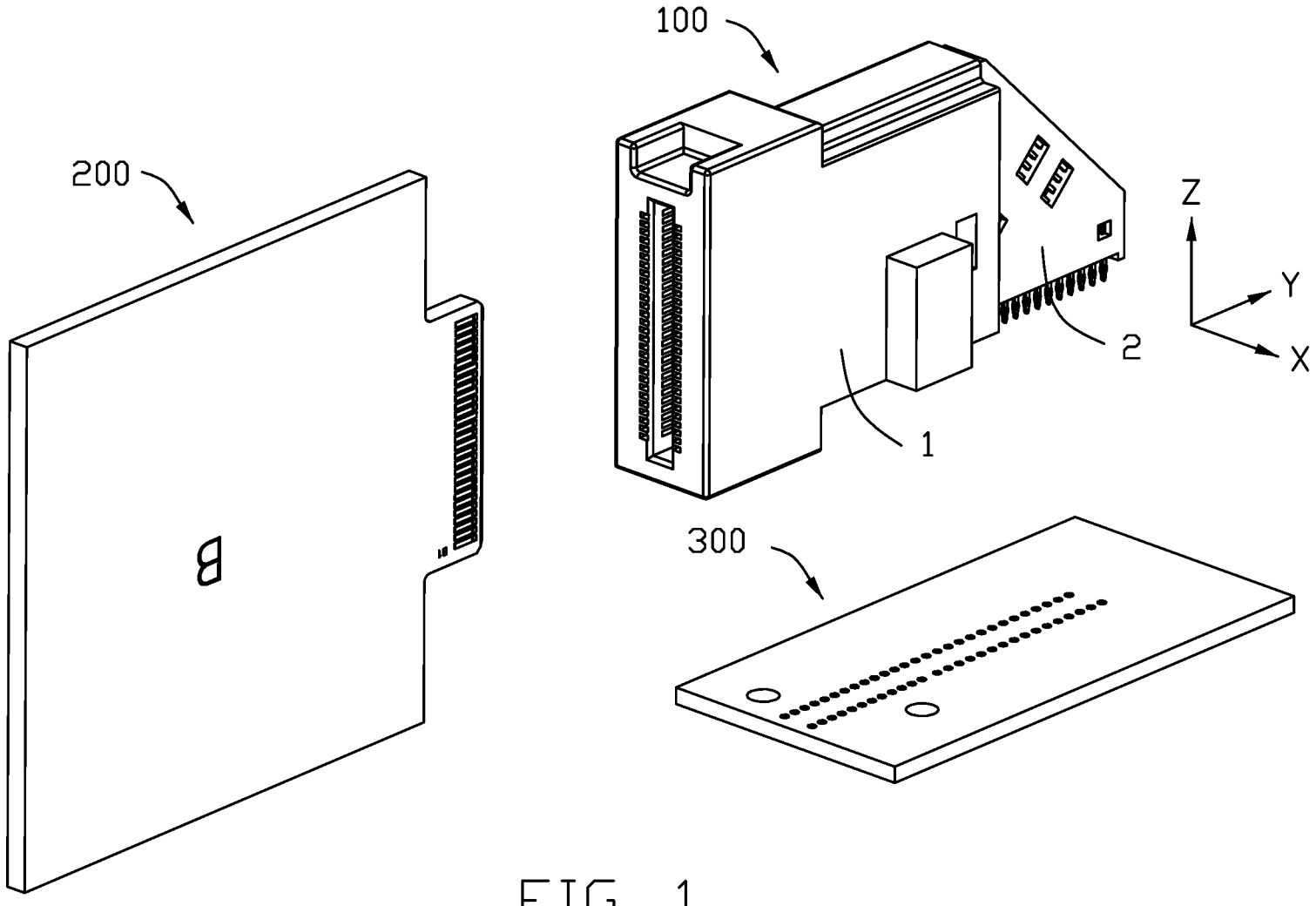
FIG. 1 is a perspective view of an electrical connector assembly according to the first embodiment of the invention.
Figure 2:
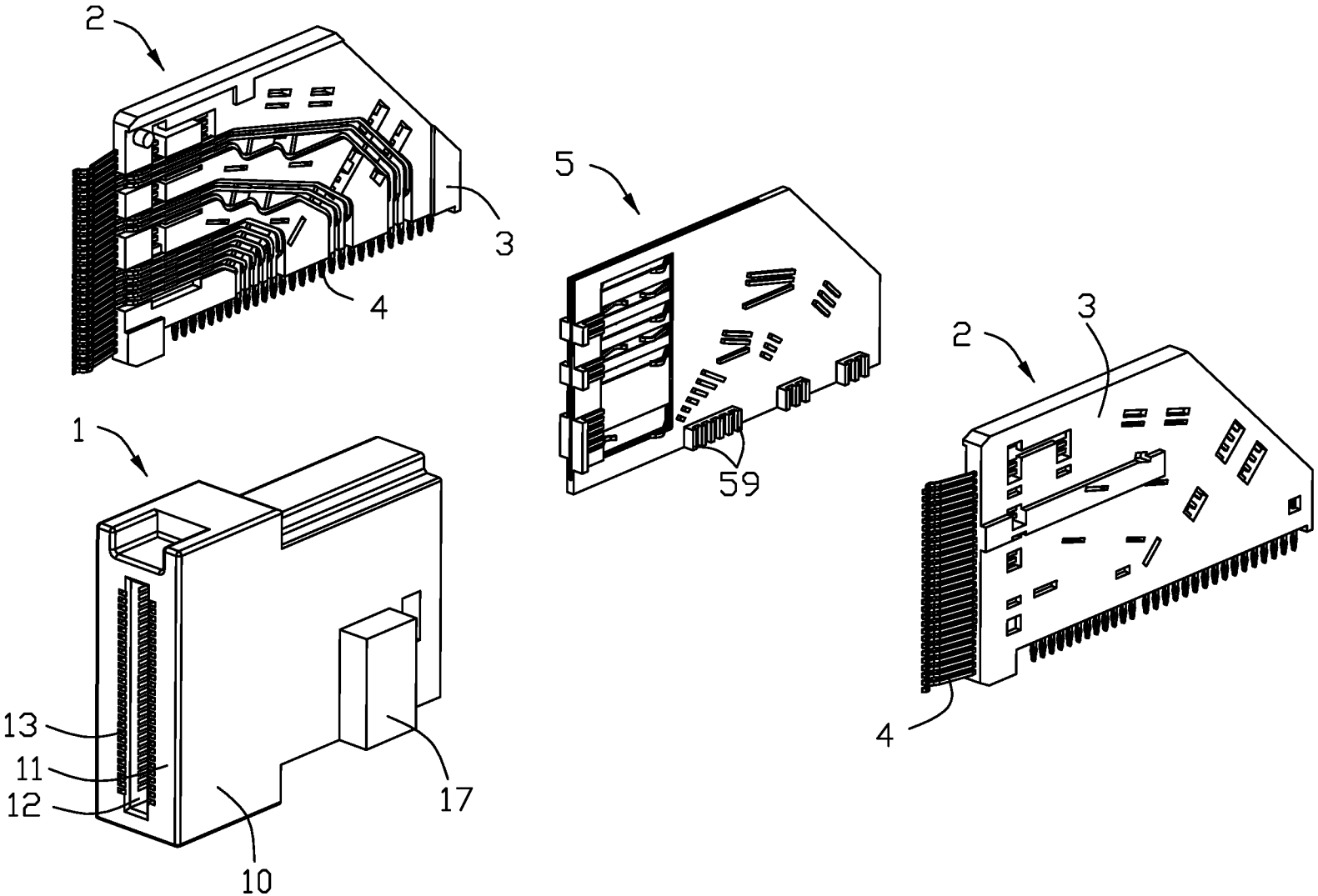
FIG. 2 is an exploded perspective view of the electrical connector of the electrical connector assembly of FIG. 1.
Figure 3:
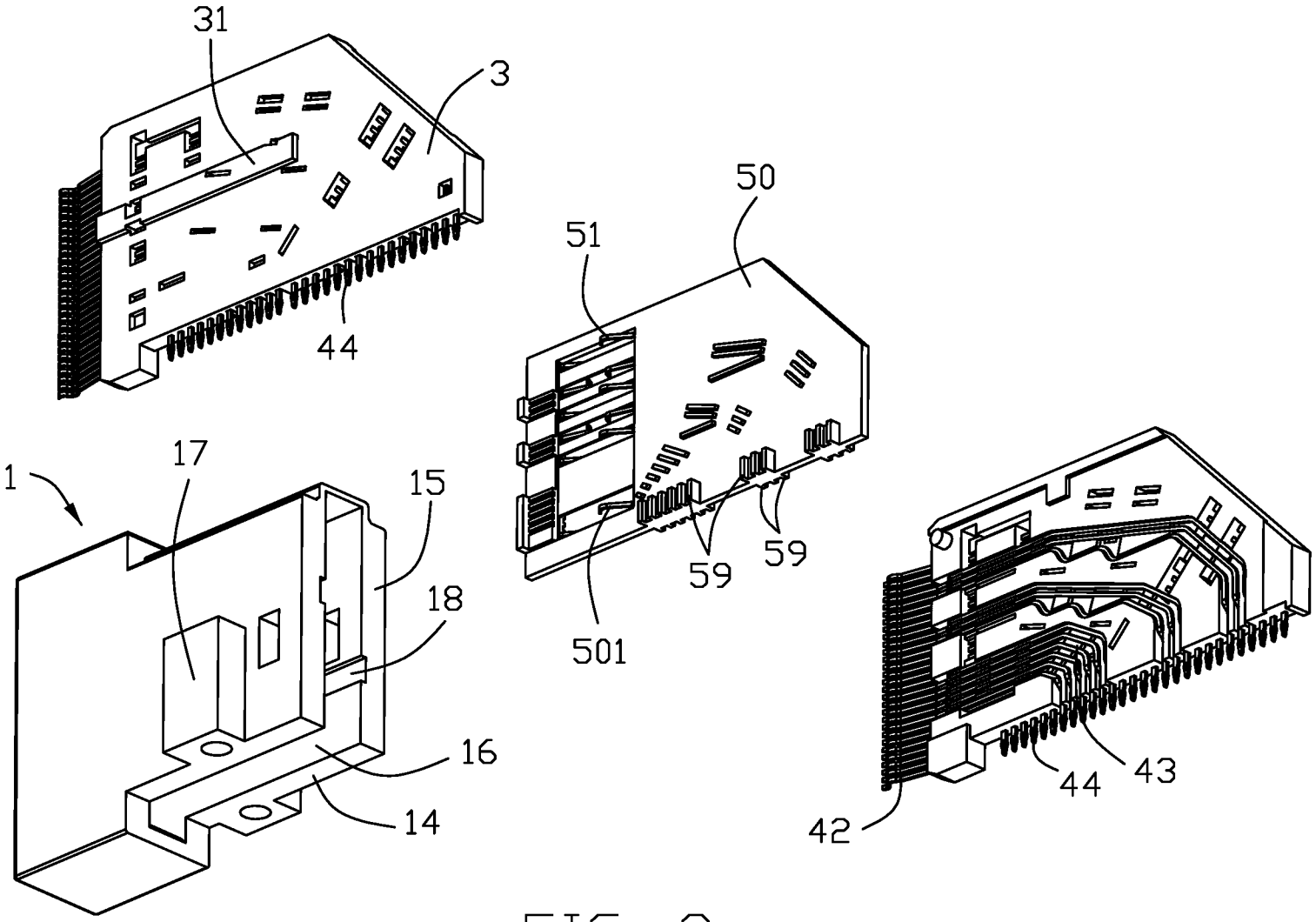
FIG. 3 is another exploded perspective view of the electrical connector of FIG. 2.

Referring to FIGS. 1-7, an electrical connector 100 for mounting to a printed circuit board 300 and mating with a complementary part having a board like mating piece 200. The electrical connector 100 includes an insulative housing 1, a pair of opposite contact modules 2 commonly sandwiching a grounding module 5 therebetween. Each contact module 2 includes an insulator 3 and the doubled-sided arranged contacts 4. As shown in FIG. 1, the housing 1 defines a front-to-back direction Y, the transverse direction X and the vertical direction Z perpendicular to one another The insulative housing 1 includes opposite side walls 10 to commonly form a receiving space (not labeled) therebetween for receiving the pair of contact modules and the grounding module 5 therebetween, and further define a vertical mating face 11, the horizontal mounting face 14 and a rear face 15. The rear face 15 is parallel to the front mating face 11 and both the rear face 15 and the front mating face 11 are perpendicular to the mounting face 14. A mating slot 12 is formed between the pair of side walls 10 and extends forwardly through the front mating face 11. Each side wall 10 forms a plurality of passageways 13 facing the mating slot 12 for receiving the corresponding contacts 4. The mounting face 14 forms an opening 16 extending through both the mounting face 14 and the rear face 15 for allowing the contact modules 2 with the grounding module 5 therebetween to be commonly inserted into the receiving space from a rear side of the housing 1. A pair of guiding grooves 18 are formed in interior surfaces of the corresponding side walls 10 and a pair of blocks 17*y* are formed on exterior surfaces of the corresponding side walls 10 both in asymmetrical manner for correct orientation assembling consideration.

Figure 4:
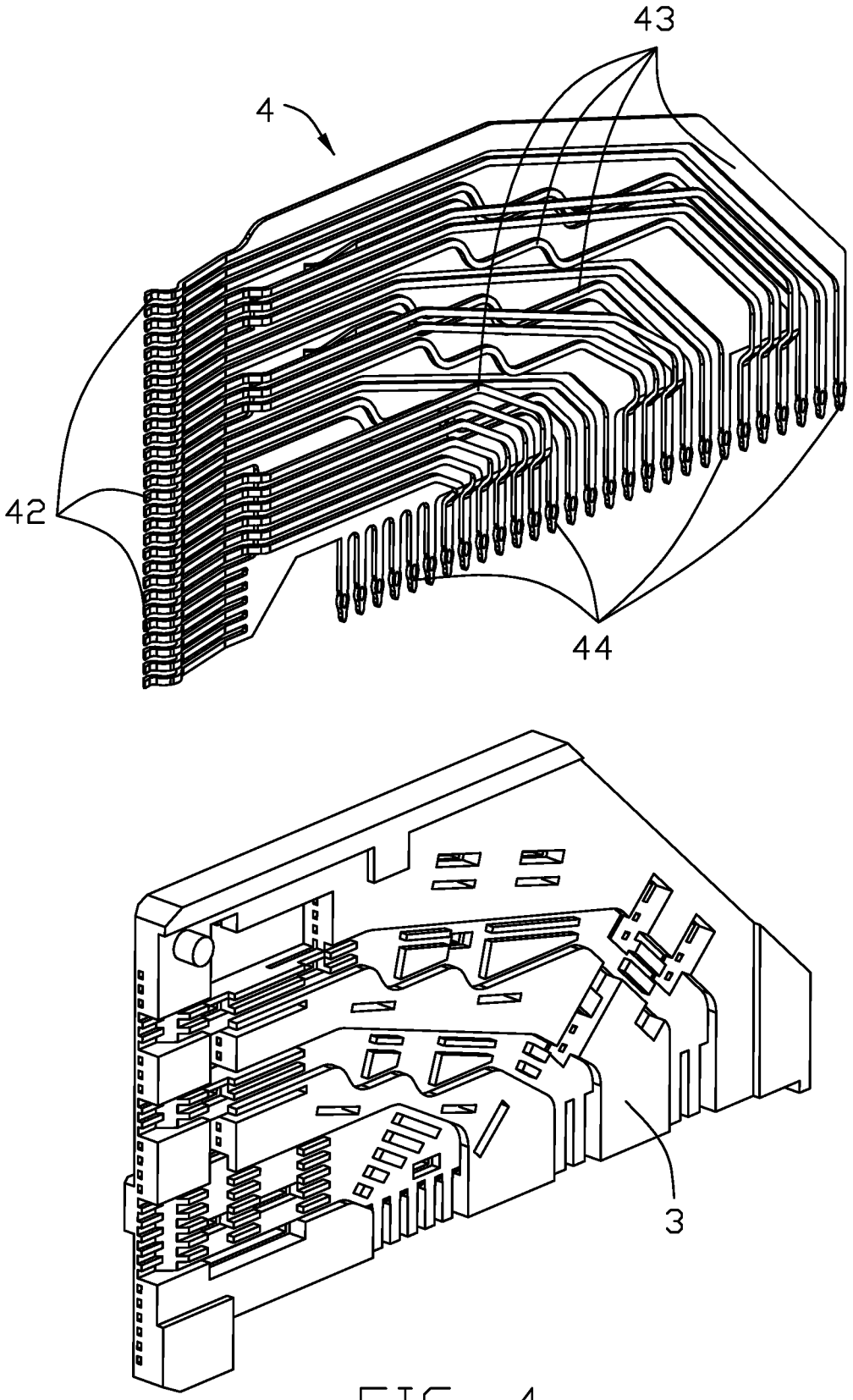
FIG. 4 is an exploded perspective view of the contact module of the electrical connector of FIG. 2.
Figure 5:
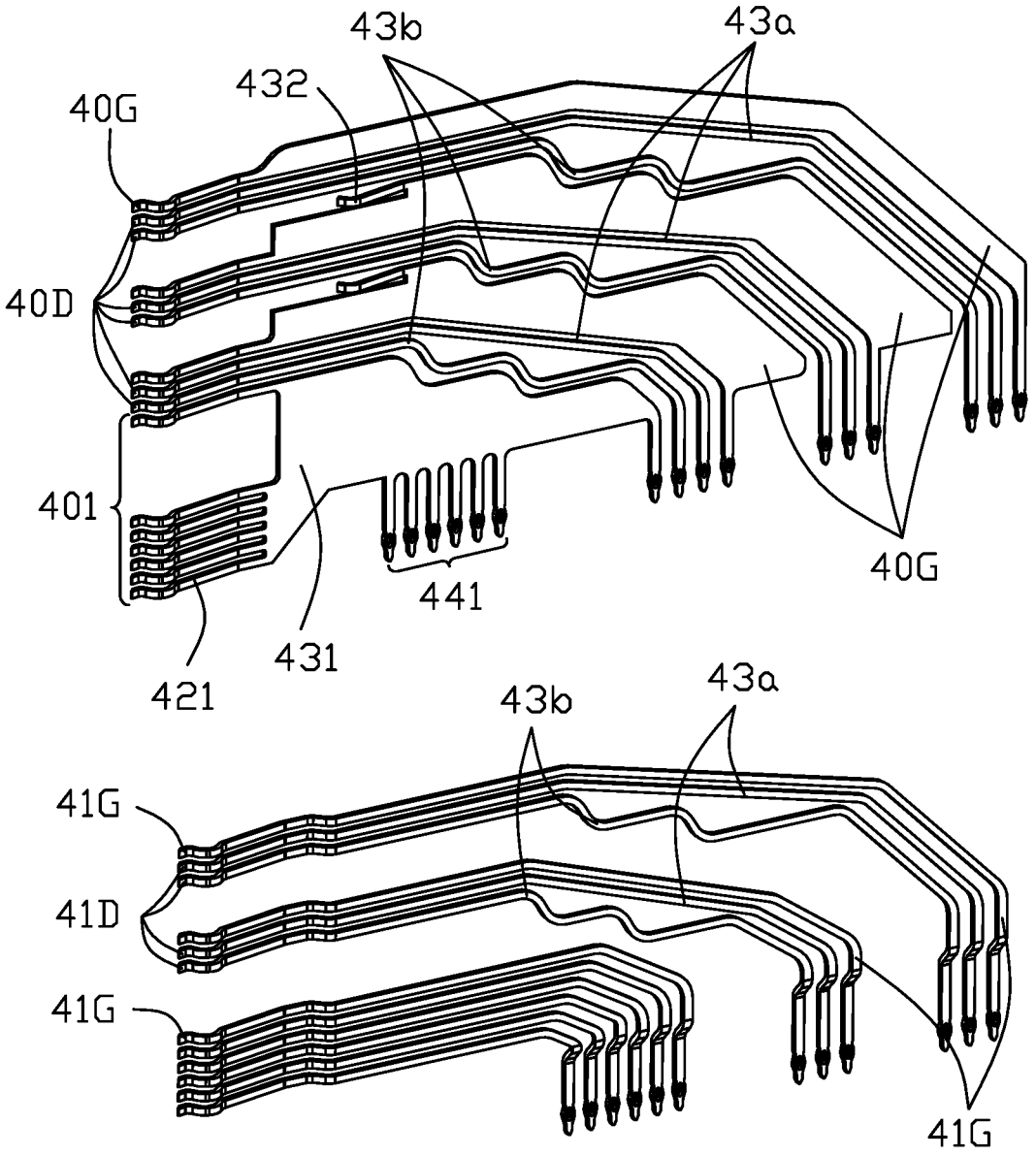
FIG. 5 is an exploded perspective view of the double-sided arranged contacts in each contact module of FIG. 4.
Figure 5A:
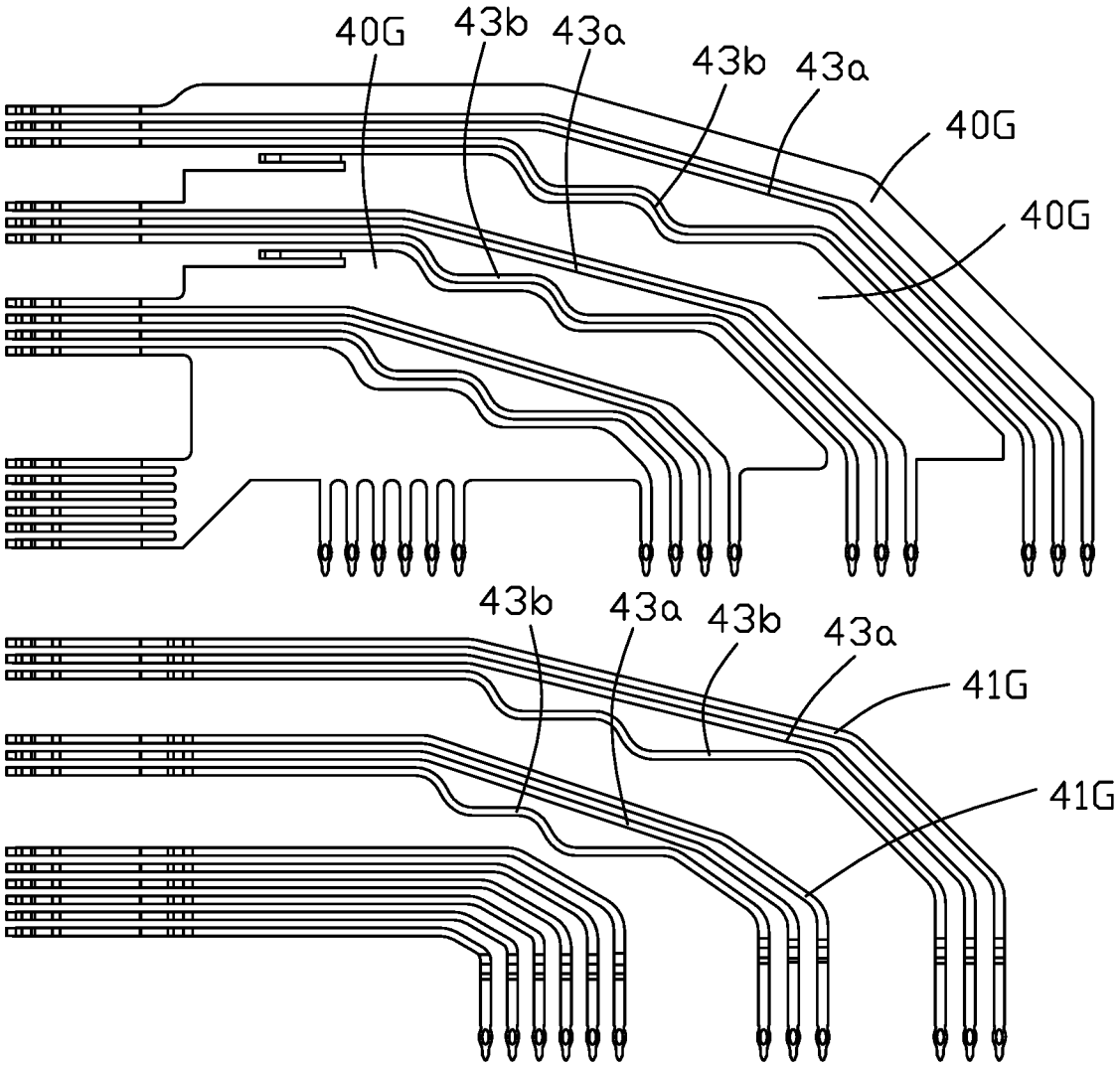
FIG. 5(A) is an exploded plan view of the double-sided arranged contacts in each contact module of FIG. 5.
Figure 6:
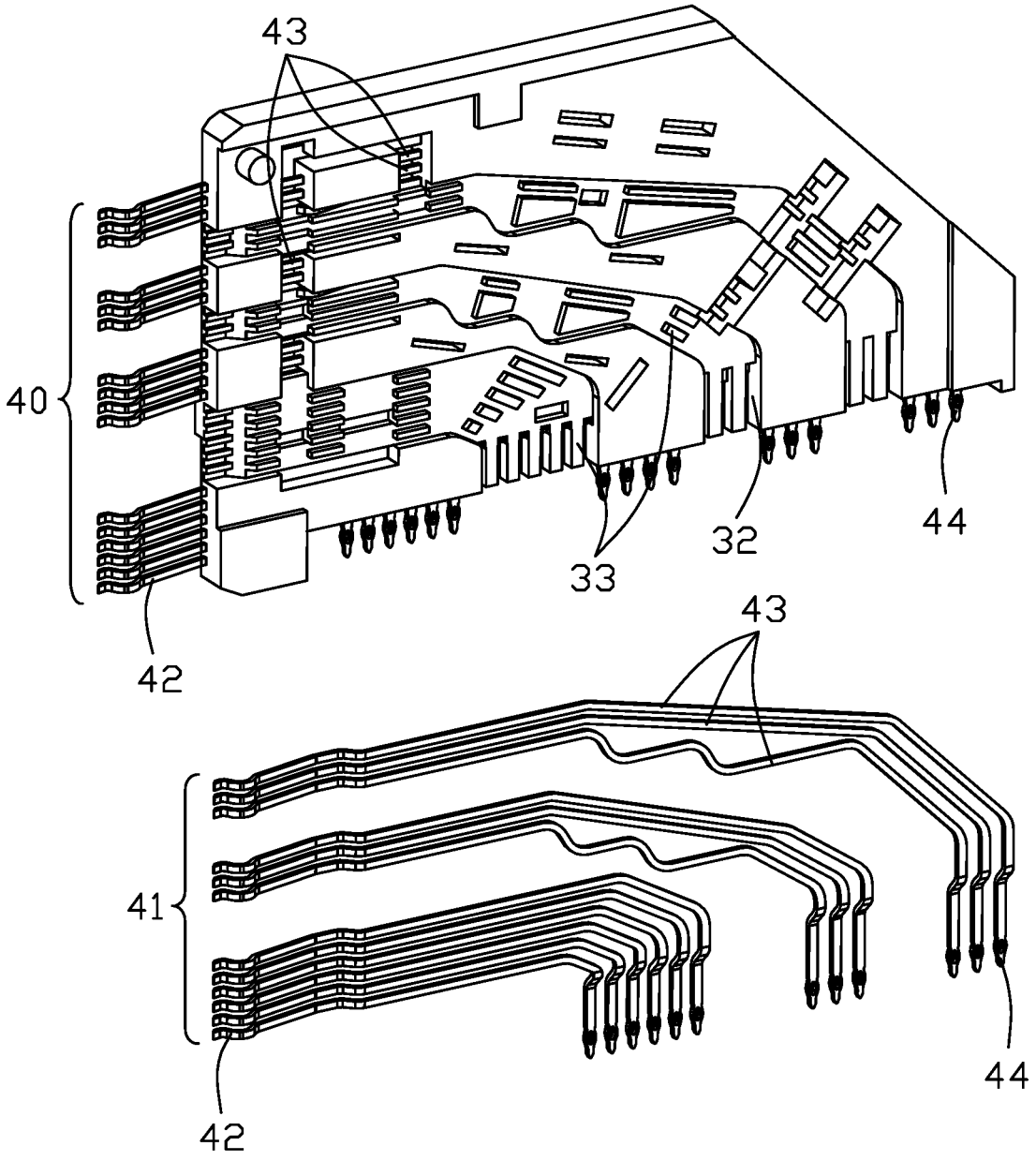
FIG. 6 is an exploded perspective view of the contact module of the electrical connector of FIG. 2 wherein one side contacts have been built within the insulator and the other side contacts are ready to be assembled to the other side thereof.

The contact module 2 includes an insulator 3 and a plurality of contacts 4 secured to the insulator 3. The contact 4 includes a contacting/mating section 42 extending into the mating slot 12, a soldering/tail section 44 extending out of the insulator 3 for mounting to the printed circuit board 300, and a retaining/connecting section 43 linked between the contacting section 42 and the soldering section 44. The contacting sections 42 of all the contacts 4 are aligned in one row along the vertical direction, and the soldering sections 44 of all contacts 4 are also aligned in one row along the front-to-back direction. The contacts 4 are divided into two groups, i.e., the first/outer (group) contacts 40 and the second/inner (group) contacts 41, with the corresponding connecting sections 42 on two sides of the insulator 3. The first contacts 40 and the second contacts 41 have the differential pair (contacts) 40D and 41D, and the grounding contacts 40G and 41G. Understandably, the differential pair 40D and the corresponding ground contact 40G commonly form a function unit as well as the differential pair 41D and the grounding contact 41G. As shown in FIGS. 4-6, each of the differential pair contacts 40D and 41D intentionally has the lower contact 43*b* extend curvedly to increase the corresponding length for compensating the shortage with regard to the upper contact 43*a*, thus equalizing the total transmission path length between the pair of differential pair contacts. In this embodiment, there are five differential pairs wherein the first contacts 40 include three differential pairs and the second contacts 41 include the other two differential pairs.

Figure 7:
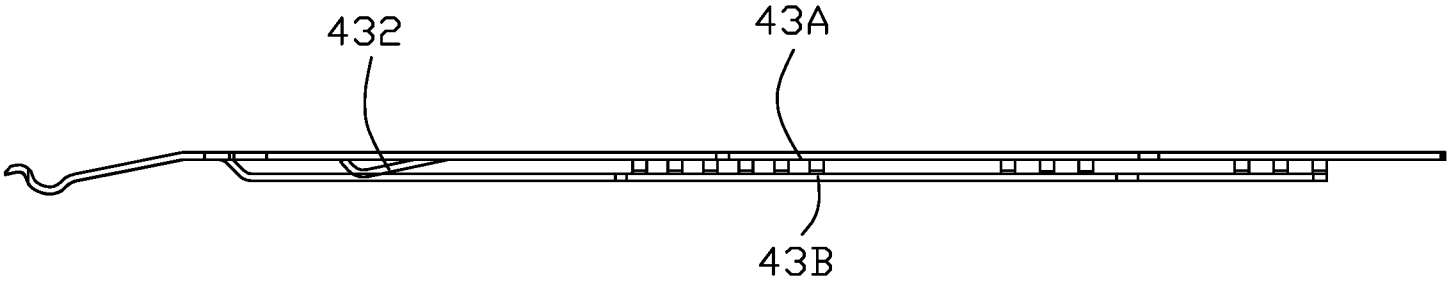
FIG. 7 is a top view of the two sides contacts of FIG. 2 of the contact module of the electrical connector of FIG. 2.
Figure 8:
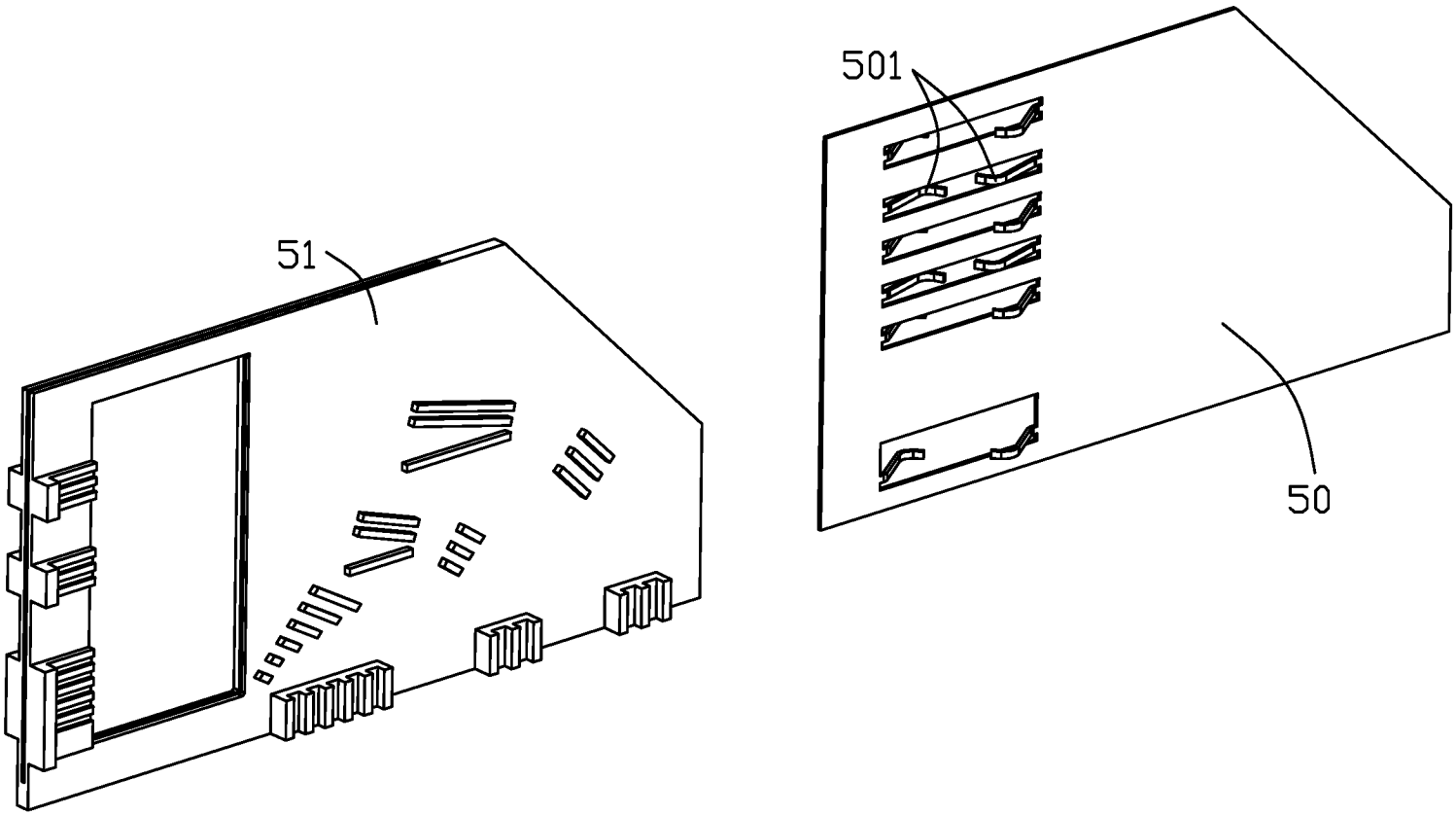
FIG. 8 is an exploded perspective view of the grounding module of the electrical connector of FIG. 2.
Figure 8A:
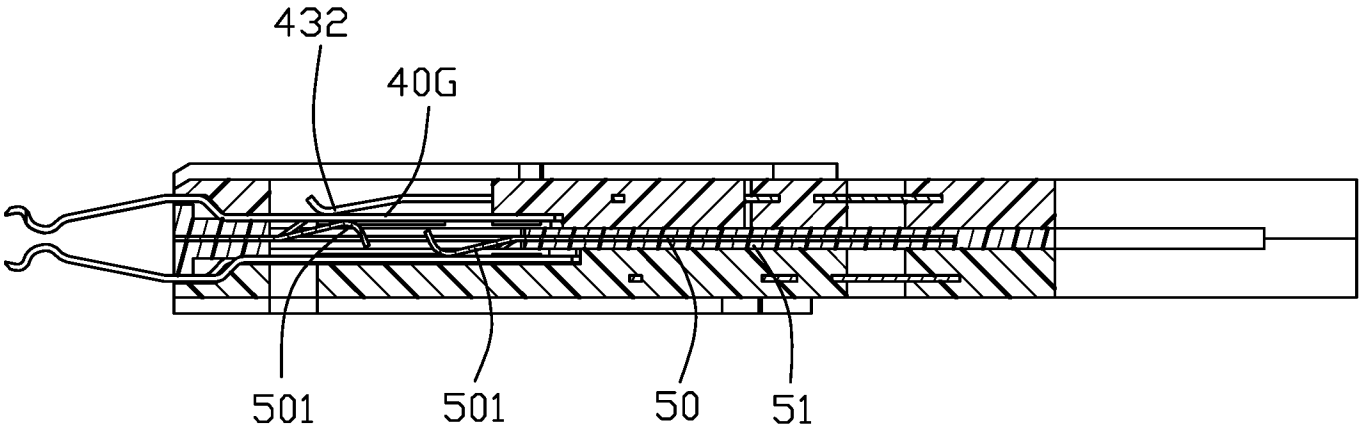
FIG. 8(A) is a cross-sectional view of the electrical connector of FIG. 1 without showing the housing.
Figure 9:
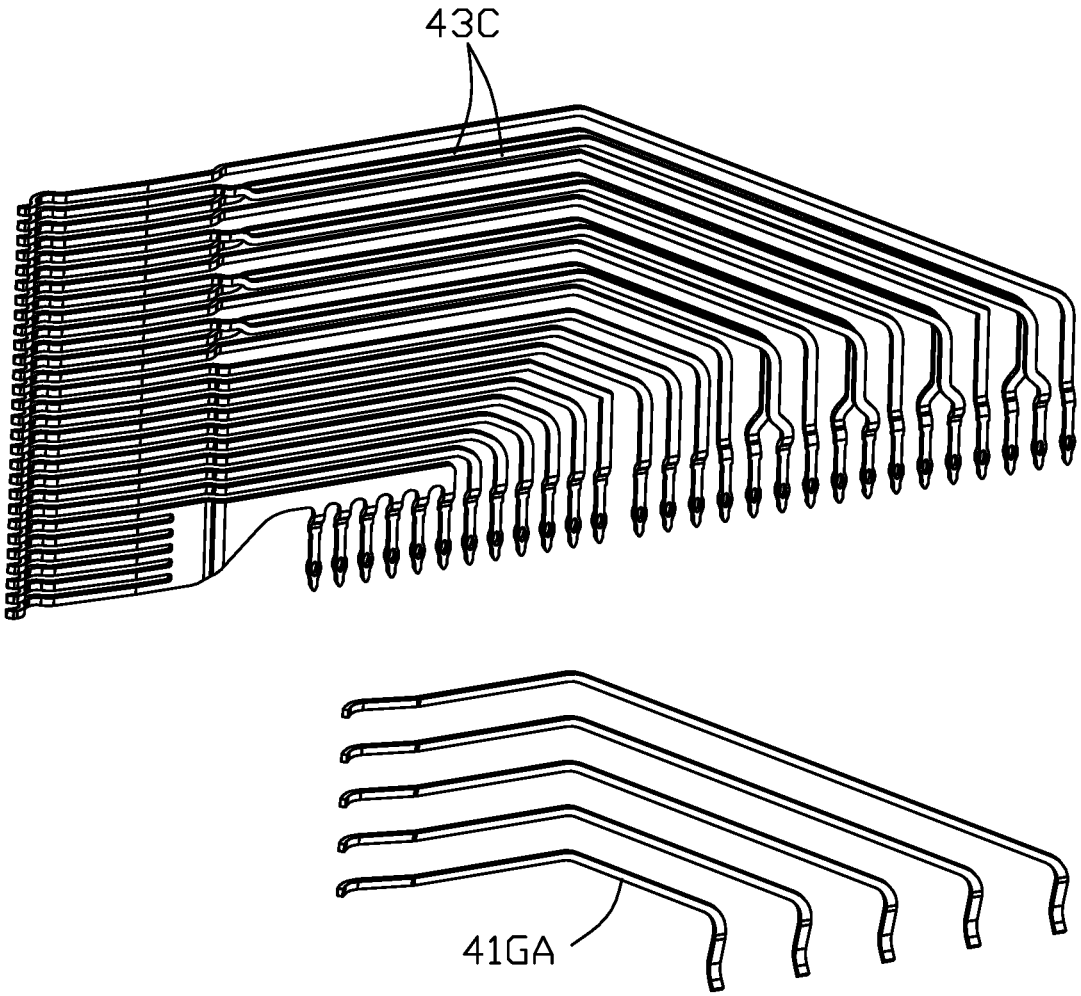
FIG. 9 is an exploded perspective view of the two sides contacts for use within the electrical connector according to a second embodiment.
Figure 10:
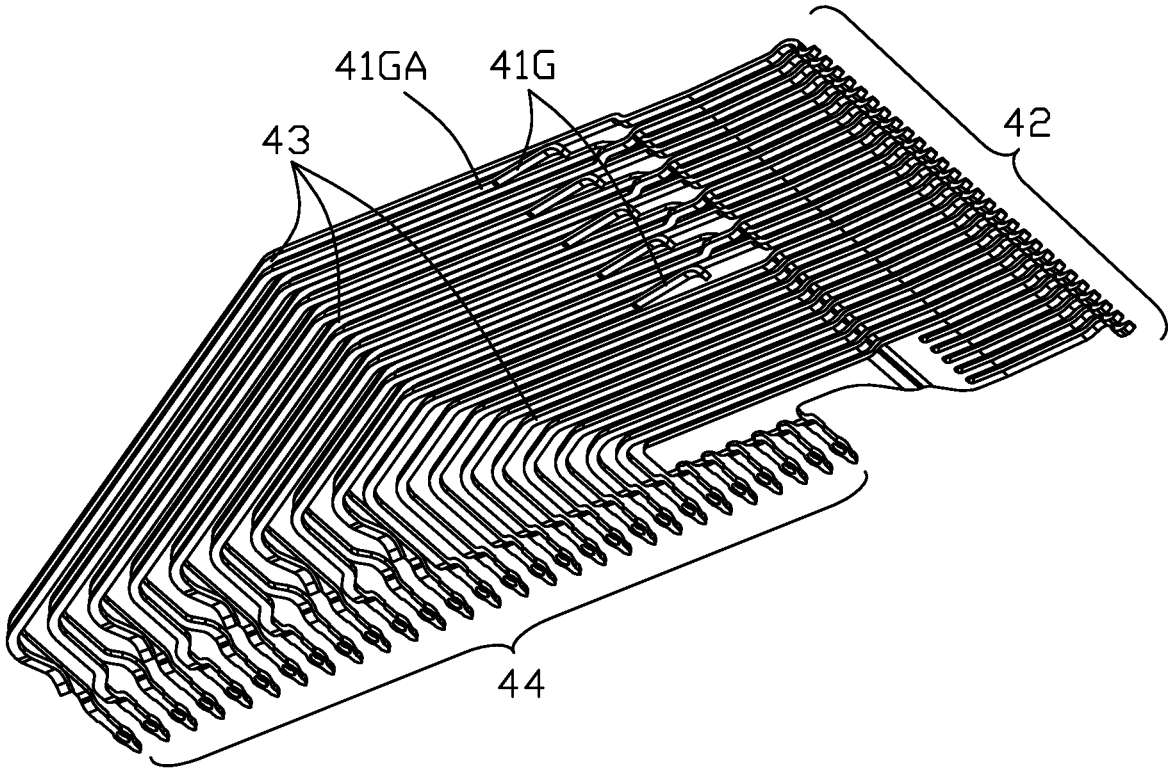
FIG. 10 is an assembled perspective view of the double-sided arranged contacts of FIG. 9 without showing the insulator of the electrical connector.
Figure 11:
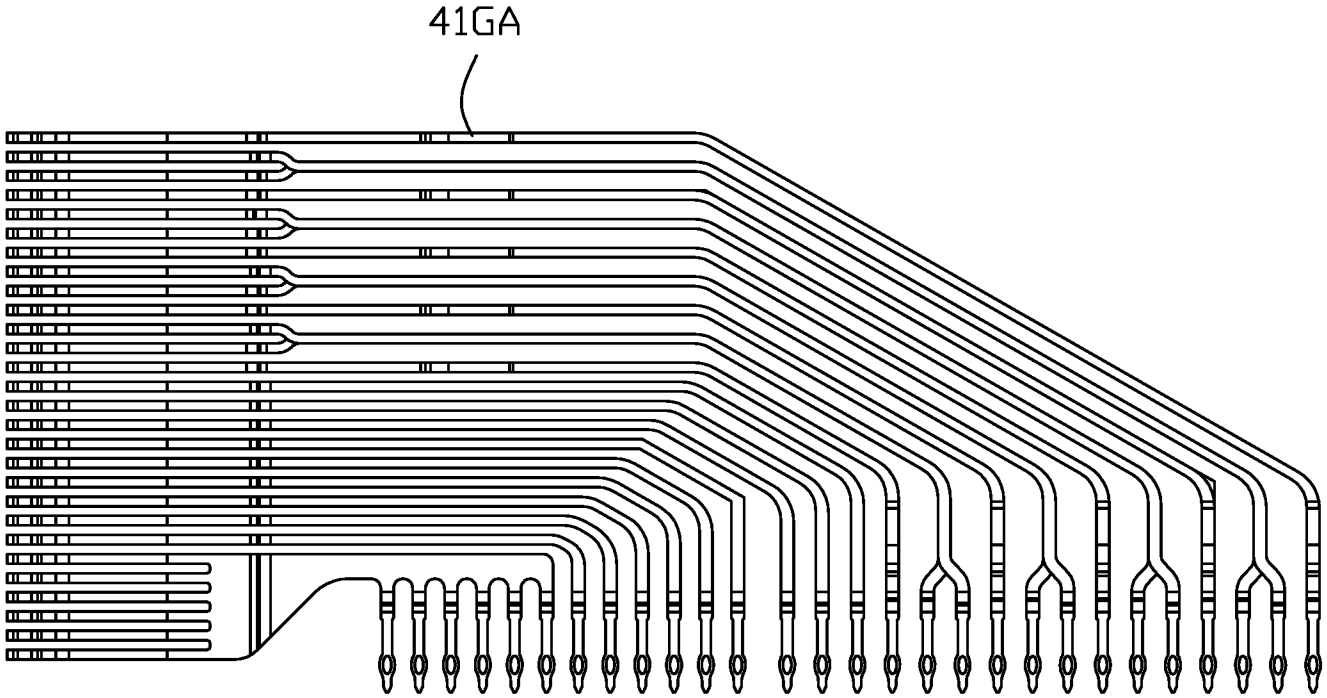
FIG. 11 is an assembled plan view of the double-sided arranged contacts of FIG. 10.

In each contact module 2, the connecting sections 43 of the first contacts 40 are integrally, via insert-molding, formed within the insulator 3, i.e. the outer side, and those of the second contacts 41 are assembled into the corresponding passages 32, which are formed by/between the corresponding ribs 33, in the other/inner side of the insulator 3 while the contacting sections 42 of the first contacts 40 and those of the second contacts are alternately arranged in one row as well as the soldering sections 44 of both the first contacts 40 and the second contacts 41. Understandably, the contacting point of the contacting section 42 faces toward mating slot 12 for mating with the board like mating piece 200. As shown in FIG. 7, the connecting sections 43 of all first contacts 40 are arranged in a same vertical plane while those of the second contacts 41 are arranged in another vertical plane parallel thereto.

Figure 5B:
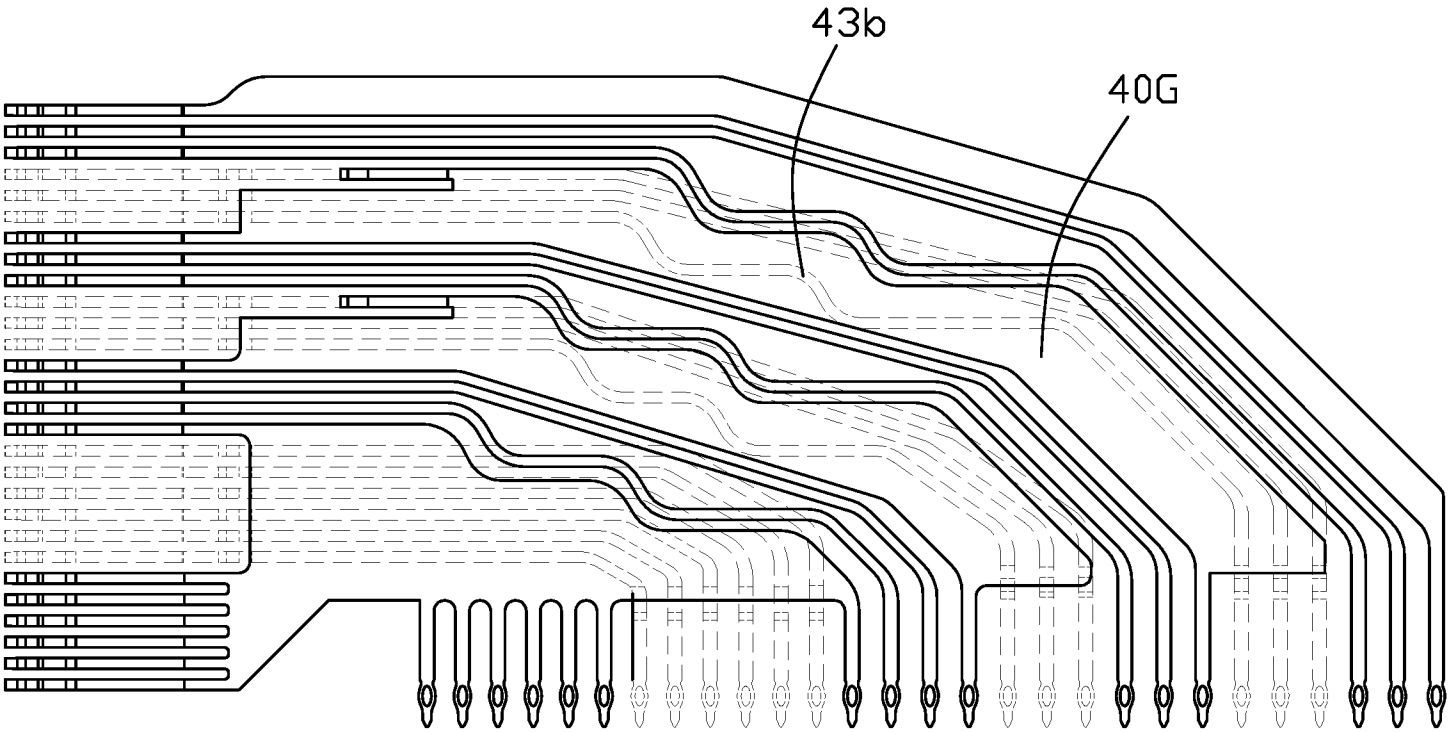
FIG. 5(B) is a plan view of the double-sided arranged contacts in the each contact module of FIG. 5(A) wherein the contacts of one side are shown in the dashed lines for comparison with those on the other side.

As shown in FIGS. 5-5(B), in the first contacts 40 there are four grounding contacts 40G and three differential pairs 40D therebetween. To enhance shielding to lower the cross-talk, the grounding contacts 40G are enlarged wherein the lowest grounding contact 40G further includes more contacting sections 421 and soldering sections 441 to form a unitary piece so as to complete the total connecting sections 42 and soldering sections 44 of the whole connector 10. Each of the middle two grounding contacts 40G includes a spring tang 432 to mechanically and electrically connect to the corresponding grounding contact 41G of the second contacts 41. It should be noted that the unitary piece formed by the lowest grounding contact 40G performs the grounding function in one contact module 2 while that in the other contact module 2 performs the power transmission. Similar to the first contacts 40, the second contacts 41 include two differential pairs 41D and a plurality of grounding contacts 41G to separate the differential pairs 41D. Notably, in both first contacts 40 and the second contacts 41, the contact length is increase from the lowest contact to the highest contact inevitably. This is the reason why in each differential pair the lower contact is required to curvedly extend to increasing the length thereof while the upper contact is not. Understandably, the other contact module 2 is arranged and configured to be symmetrical with contact module 2 with regard to an imaginary vertical plane. Notably, in the contacting sections 42 of both the first contacts 40 and the second contacts 41, from top to bottom the sequence is that the grounding contact 40G, the differential pair 40D, the grounding contact 41G, the differential pair 41D, etc.

As shown in FIGS. 2-3 and 8-8(A), the grounding module 5 is located between the pair of contact modules 2 in the transverse direction perpendicular to both the front-to-back direction and the vertical direction, and includes a (middle) insulator 51 and an enlarged grounding/shielding plate/contact 50 integrally formed therein via an insert-molding process. In this embodiment, the grounding contacts 50 are unified together as one piece. The grounding plate 50 includes a plurality of spring fingers 501 to mechanically and electrically connect to the corresponding grounding contacts 41G, respectively. Therefore, through the spring tangs 432 of the first grounding contacts 40G, which connect to the corresponding grounding contacts 41G, and through the spring fingers 501 of the grounding contact 50, which also connect to the corresponding grounding contacts 41G, all the grounding contacts 40G, 41G and 50 are electrically unified together for enhancing grounding/shielding effect. In assembling, the pair of contact modules 2 sandwiching the grounding module 5 therebetween are commonly inserted into the receiving space via the rear face 15 wherein the insulator 3 includes a guiding block 31 moved along the corresponding guiding groove 18. The middle insulator 51 forms on two opposite sides a plurality of ribs 59 adapted to be received within the corresponding passages 32 so as to cooperate with the insulators 3 to commonly sandwich therebetween the corresponding second contacts 41, which are assembled within the corresponding passages 32, for efficiently retaining the second contacts 41 in position with regard to the insulator 3.

Figure 12:
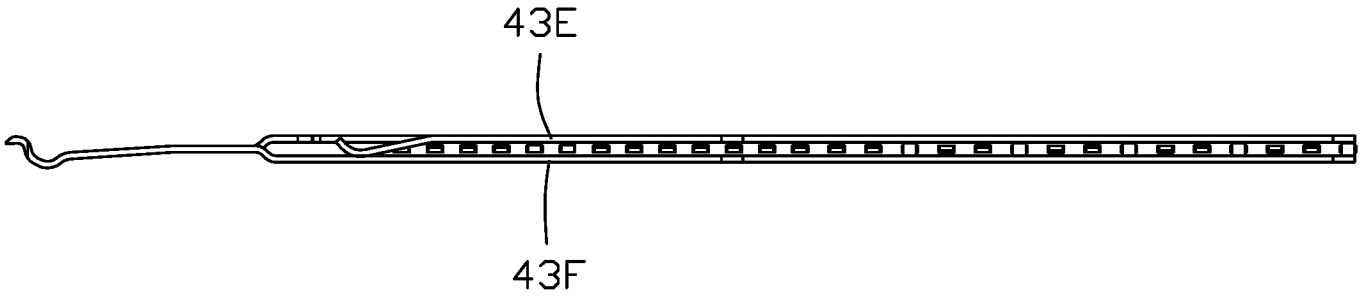
FIG. 12 is an assembled top view of the double-sided arranged contacts of FIG. 10.

Referring to FIGS. 9-12, in the second embodiment the connecting sections 43C of the differential pair are located at different vertical planes but in a parallel relation with each other in the transverse direction so as to obtain the same length between each differential pair. As shown in FIG. 12, in each differential pair the connecting section 43E of the upper contact and the connecting section 43F of the lower contact are located at two different spaced vertical planes while those of the remaining contacts are still located in a same middle vertical plane between these two spaced vertical planes. In this embodiment, each contact module includes a plurality of grounding contacts 41G to separate the corresponding differential pairs, wherein there are five additional grounding contacts 41GA located, in parallel relation along the transverse direction, beside and connected with the connecting sections 43C of the corresponding grounding contacts 41 without the contacting section and the soldering section thereof. Notably, the additional grounding contacts 41GA are located at a same vertical plane with the connecting sections 34F of the lower contacts.

What is claimed is:

1. An electrical connector comprising:

an insulative housing defining a receiving space therein and defining a front-to-back direction, a vertical direction perpendicular to the front-to-back direction, and a transverse direction perpendicular to both the front-to-back direction and the vertical direction:

a pair of contact modules commonly received within the receiving space in an opposite manner, each contact module including:

a vertical insulator:

a plurality of contacts secured to the insulator, each of said contacts including along the front-to-back direction, a front mating section, a rear soldering section and a middle retaining section therebetween wherein the connecting sections of all the contacts are located in a same vertical plane; and the contacts including a plurality of differential pair contacts and a plurality of grounding contact alternately arranged with each other; wherein in each differential pair of said differential pair contacts, the connecting section of a lower contact extends curvedly while that of an upper contact extends essentially straight differently so as to compensate a total transmission length difference between the upper contact and the lower contact in said differential pair; wherein the grounding contact in a neighboring differential pair, which is intimately adjacent to the lower contact of said differential pair, is enlarged/expanded in said vertical plane; wherein an expansion configuration of the grounding contact in the neighboring differential pair is intimately comply with a curved extension of the connecting section of the lower contact of said differential pair.

2. The electrical connector as claimed in claim 1, wherein said contacts include a plurality of outer contacts and a plurality of inner contacts respectively located at two opposite outer side and inner side of the insulator, both the outer contacts and the inner contacts have the corresponding differential pair contacts and the corresponding grounding contacts, and only the connecting sections of the outer contacts and those of the inner contacts are spaced from each other in two different vertical planes while the contacting sections of both the inner contacts and the outer contacts are located in a same vertical plane as well as the connecting sections.

3. The electrical connector as claimed in claim 2, wherein in the connecting sections of both said outer contacts and said inner contacts are arranged in sequence as the grounding contact of the outer contacts, the differential pair of the outer contacts, the grounding contact of the inner contacts, and the differential pair of the inner contacts, etc.

4. The electrical connector as claimed in claim 2, wherein the outer contacts are integrally formed within the insulator via an insert-molding process while the inner contacts are assembled to an inner side of the insulator.

5. The electrical connector as claimed in claim 2, wherein the connecting sections and the soldering sections of the outer contacts are located in the same vertical plane while the connecting sections and the soldering sections of the inner contacts are located in two different vertical planes.

6. The electrical connector as claimed in claim 2, wherein the lower contact of the differential pair of the inner contacts is essentially aligned with an expanded grounding contacts of the outer contacts in the transverse direction.

7. The electrical connector as claimed in claim 2, wherein one of the grounding contact of the inner contacts and the grounding contact of the outer contacts includes a spring tang extends toward and mechanically and electrically connects to the other.

8. The electrical connector as claimed in claim 2, further including a grounding module sandwiched between the pair of contact module in the transverse direction, wherein the grounding module includes a metallic grounding plate integrally formed within a middle insulator via an insert-molding process and equipped with a plurality of spring fingers respectively mechanically and electrically connecting to the corresponding grounding contacts of the inner contacts of both two contact modules.

9. The electrical connector as claimed in claim 8, wherein the inner contacts are assembled to corresponding passages in the inner side of the insulator, and the middle insulator forms a plurality of ribs inserted into the corresponding passages to commonly sandwich the inner contacts therebetween in the transverse direction.

10. The electrical connector as claimed in claim 9, wherein the ribs are formed on two opposite sides of the middle insulator to cooperate with the passages formed in the corresponding inner sides of said two contact modules by two sides in the transverse direction.

11. An electrical connector comprising:

an insulative housing forming a receiving space therein and defining a front-to-back direction, a vertical direction perpendicular to the front-to-back direction, and transverse direction perpendicular to both the front-to-back direction and the vertical direction;

a pair of contact modules commonly received within the receiving space, each of said contacts including:

a vertical insulator defining opposite first and second sides in the transverse direction; and a group of first contacts and a group of second contacts secured to the insulator, each group of said first contacts and said second contacts including a plurality of grounding contacts and a plurality of differential pair contacts, each of said first contacts and said second contacts including a front mating section extending into a mating slot in the housing, a rear soldering section extending out of the hosing and a middle connecting section retained to the insulator, wherein the connecting sections of the first contacts essentially retained to a first side while the connecting sections of the second contacts essentially retained to the second side, and the contacting sections of both said first contacts and said second contacts are arranged in one row in the vertical direction in an alternate manner;

wherein in each group of said first contacts and said second contacts, one differential pair and one grounding contact commonly form a unit, and the units of the first contacts and those of the second contacts are alternately arranged with each other in said one row along the vertical direction; wherein the first contacts are integrally formed within the first side of the insulator via an insert-molding process while the second contacts are assembled to the second side of the insulator.

12. The electrical connector as claimed in claim 11, further including a grounding module sandwiched between the pair of contact modules in the transverse direction and essentially consisting of a middle insulator with a metallic grounding sheet secured thereto, wherein the grounding sheet includes a plurality of spring fingers respectively mechanically and electrically connecting to the corresponding grounding contacts of the second contacts both the contact modules.

13. The electrical connector as claimed in claim 12, wherein the grounding contacts of one group of the first contacts and the second contacts include spring tangs to mechanically and electrically connect to the other group of said first contacts and said second contacts.

14. The electrical connector as claimed in claim 12, wherein the second contacts are assembled into corresponding passages in the insulator, and the middle insulator forms a plurality of ribs inserted into the corresponding passages to commonly sandwich the corresponding second contacts therebetween in the transverse direction for securing the second contacts in position.

15. An electrical connector comprising:

an insulative housing defining a receiving space therein and defining a front-to-back direction, a vertical direction perpendicular to the front-to-back direction, and a transverse direction perpendicular to both the front-to-back direction and the vertical direction;

a pair of contact modules commonly received within the receiving space in an opposite manner, each contact module including:

a vertical insulator;

a plurality of contacts secured to the insulator, each of said contacts including along the front-to-back direction, a front mating section, a rear soldering section and a middle retaining section therebetween wherein the connecting sections of all the contacts are located in a same vertical plane; and the contacts including a plurality of differential pair contacts and a plurality of grounding contact alternately arranged with each other; wherein in each differential pair of said differential pair contacts, the connecting section of a lower contact extends curvedly while that of an upper contact extends essentially straight differently so as to compensate a total transmission length difference between the upper contact and the lower contact in said differential pair; wherein said contacts include a plurality of outer contacts and a plurality of inner contacts respectively located at two opposite outer side and inner side of the insulator, both the outer contacts and the inner contacts have the corresponding differential pair contacts and the corresponding grounding contacts, and only the connecting sections of the outer contacts and those of the inner contacts are spaced from each other in two different vertical planes while the contacting sections of both the inner contacts and the outer contacts are located in a same vertical plane as well as the connecting sections; wherein in the connecting sections of both said outer contacts and said inner contacts are arranged in sequence as the grounding contact of the outer contacts, the differential pair of the outer contacts, the grounding contact of the inner contacts, and the differential pair of the inner contacts, etc.; wherein the outer contacts are integrally formed within the insulator via an insert-molding process while the inner contacts are assembled to an inner side of the insulator.

16. The electrical connector as claimed in claim 15, wherein the connecting sections and the soldering sections of the outer contacts are located in the same vertical plane while the connecting sections and the soldering sections of the inner contacts are located in two different vertical planes.

17. The electrical connector as claimed in claim 15, wherein the lower contact of the differential pair of the inner contacts is essentially aligned with an expanded grounding contacts of the outer contacts in the transverse direction.

18. The electrical connector as claimed in claim 15, wherein one of the grounding contact of the inner contacts and the grounding contact of the outer contacts includes a spring tang extends toward and mechanically and electrically connects to the other.

19. The electrical connector as claimed in claim 15, further including a grounding module sandwiched between the pair of contact module in the transverse direction, wherein the grounding module includes a metallic grounding plate integrally formed within a middle insulator via an insert-molding process and equipped with a plurality of spring fingers respectively mechanically and electrically connecting to the corresponding grounding contacts of the inner contacts of both two contact modules.

20. The electrical connector as claimed in claim 19, wherein the inner contacts are assembled to corresponding passages in the inner side of the insulator, and the middle insulator forms a plurality of ribs inserted into the corresponding passages to commonly sandwich the inner contacts therebetween in the transverse direction.

* * * * *